United States Patent [19]

Müller et al.

[11] 4,193,682

[45] Mar. 18, 1980

[54] APPARATUS FOR DEVELOPING LATENT IMAGES OF X-RAYED OBJECTS

[75] Inventors: Jürgen Müller, Munich; Josef Pfeifer, Unterhaching; Alfred Rheude, Munich; Rolf Erckel, Munich; Heinrich Färber, Munich; Bernhard Zrenner, Munich, all of Fed. Rep. of Germany

[73] Assignee: AGFA-Gevaert, A.G., Leverkusen, Fed. Rep. of Germany

[21] Appl. No.: 925,516

[22] Filed: Jul. 17, 1978

[30] Foreign Application Priority Data

Jul. 21, 1977 [DE] Fed. Rep. of Germany ..... 2733072

[51] Int. Cl.[2] ..... G03G 15/10

[52] U.S. Cl. ..... 355/10; 118/648; 118/662; 354/320; 430/103

[58] Field of Search ..... 355/3 R, 10, 133; 427/15; 118/DIG. 23, 648, 649, 659, 660, 662; 250/315 R, 315 A; 354/319, 320, 329, 330

[56] References Cited

U.S. PATENT DOCUMENTS

| | | | |
|---|---|---|---|
| 3,245,330 | 4/1966 | Okishima | 355/10 |
| 3,752,119 | 8/1973 | Matkan | 355/10 X |

FOREIGN PATENT DOCUMENTS

| | | | |
|---|---|---|---|
| 964053 | 3/1975 | Canada | 355/10 |
| 2134428 | 1/1972 | Fed. Rep. of Germany | 355/10 |
| 2413836 | 9/1975 | Fed. Rep. of Germany | 355/10 |

*Primary Examiner*—Fred L. Braun

*Attorney, Agent, or Firm*—Peter K. Kontler

[57] ABSTRACT

Apparatus for developing latent images of X-rayed objects on dielectric receptor sheets has a carrier which advances receptor sheets along a circular path about a horizontal axis. A tank with an open top is installed below the six o'clock position of the carrier and contains a horizontal developing electrode having narrow elongated channels extending in parallelism with the axis of the carrier. A pump draws liquid developer from a vessel in which the tank is confined and admits the developer into the bottom zone of the tank wherein the developer rises to fill and flow above the channels of the electrode and to thereby contact the latent image of a sheet on the moving carrier. The surplus of liquid developer overflows the upper edge of the tank and returns into the vessel. The electrode is movable up and down by rotary eccentrics to thereby influence the development of latent images, especially the development of outlines of dark portions of the images.

15 Claims, 4 Drawing Figures

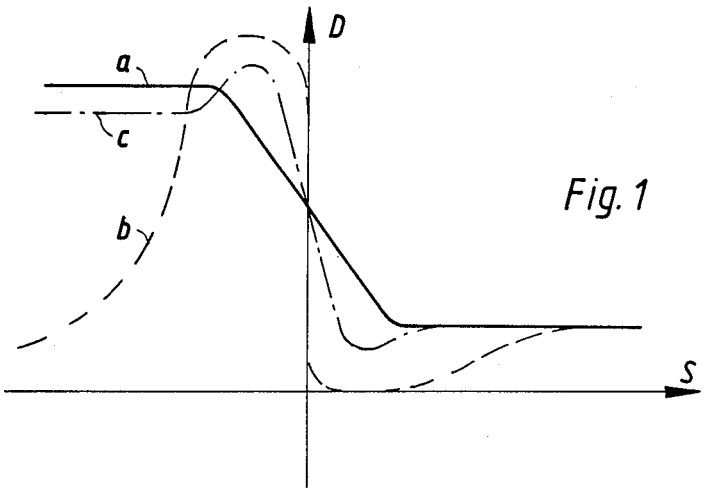
Fig. 1
Fig. 2
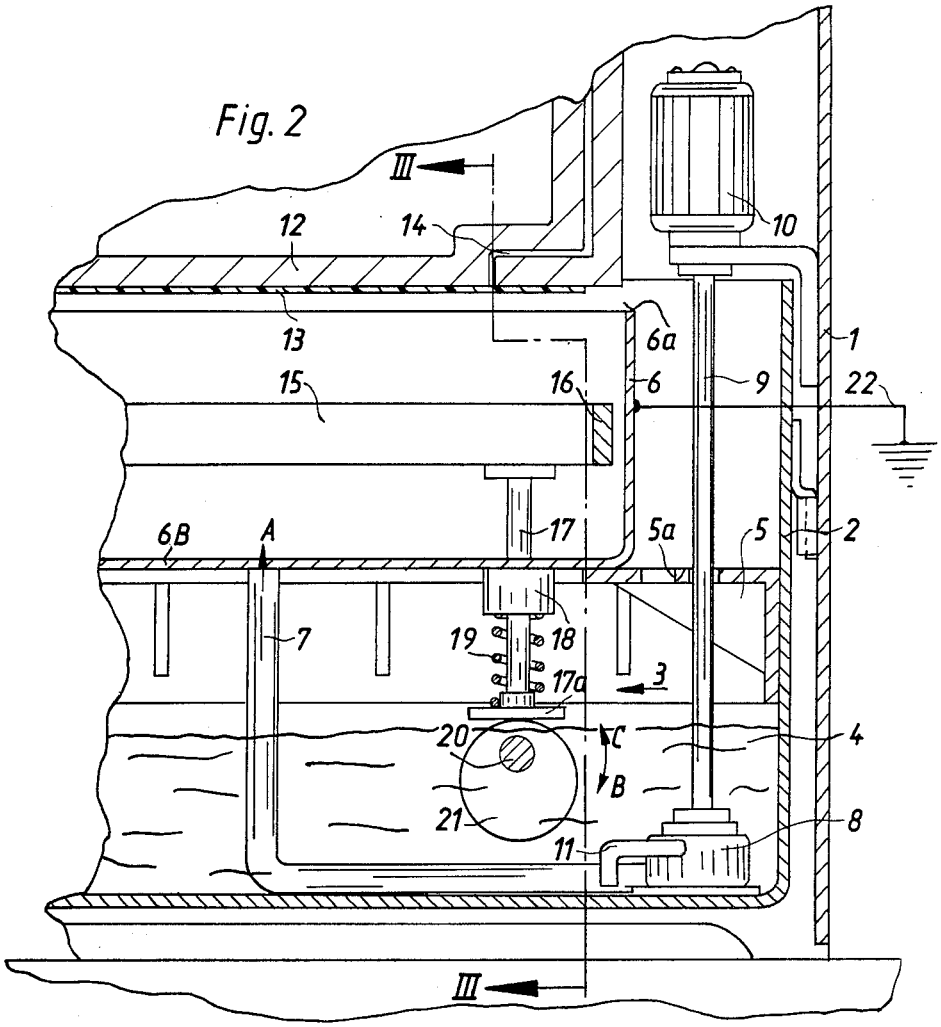

APPARATUS FOR DEVELOPING LATENT IMAGES OF X-RAYED OBJECTS

BACKGROUND OF THE INVENTION

The present invention relates to electrophotographic developing apparatus wherein carriers of latent images are contacted by a liquid developer, especially to apparatus for developing latent images on dielectric receptor sheets which were exposed to object-modulated X-rays, for example, in an ionography imaging chamber. More particularly, the invention relates to improvements in developing apparatus of the type disclosed in commonly owned German Offenlegungsschrift No. 2,545,333 published Apr. 22, 1976.

When a dielectric receptor sheet is exposed to radiation in an ionography imaging chamber, the charge of the latent image is substantially lower than the charge of a latent electrostatic image which is obtained by an electrophotographic technique. Such lower charges are satisfactory because, and as disclosed in the aforementioned German publication, the developing electrodes (which are interrupted by paths for a flowing liquid developer) can be placed into close or immediate proximity of the dielectric receptor sheet which carries the latent image. As a rule, the paths for liquid developer are narrow so that the developer is free of turbulence and, by proper selection of the speed of the developer, the receptor sheet is contacted by a body of liquid which forms a laminar flow. Consequently, the developing apparatus is highly sensitive and can accurately reproduce half-tone images. Moreover, one can eliminate the so-called edge effect which is a phenomenon that cannot be avoided when a latent image is developed in an electrophotographic developing apparatus. The term "edge effect" is intended to denote that only the outline of a dark area is visible, i.e., the major part of the dark area is light grey or white, the same as the region immediately surrounding the dark area.

As a rule, the edge effect is a highly undesirable phenomenon which is an unavoidable by-product of conventional electrophotographic developing procedures. On the other hand, such edge effect, or a certain amount of edge effect, may be desirable when the image of an X-rayed object is examined by a technician, nurse or physician.

OBJECTS AND SUMMARY OF THE INVENTION

An object of the invention is to provide a novel and improved apparatus for development of latent images on dielectric receptor sheets which enables the operator to select the contrast of the developed image in a simple, time-saving and inexpensive way.

Another object of the invention is to provide an apparatus which can be adjusted to produce developed images without any, with some or with a pronounced edge effect.

A further object of the invention is to provide an apparatus which can develop half-tone images.

An additional object of the invention is to provide the apparatus with a novel and improved developing electrode and with novel and improved means for mounting the electrode.

A further object of the invention is to provide a developing apparatus whose versatility greatly exceeds the versatility of heretofore known apparatus wherein latent images on dielectric receptor sheets are contacted by a liquid developer.

An additional object of the invention is to provide a developing apparatus which exhibits the above outlined features and advantages and can develop latent images at a rate which at least equals the output of presently known apparatus.

Another object of the invention is to provide a developing apparatus which can be rapidly converted from one mode of operation to another mode of operation, and wherein such conversion can be carried out by semiskilled or unskilled persons.

The invention is embodied in an apparatus for treating latent images on receptor sheets with a liquid developer, particularly for developing latent images on dielectric receptor sheets which were exposed to object-modulated X-rays in an ionography imaging chamber, e.g., an imaging chamber of the type disclosed in commonly owned U.S. Pat. No. 4,021,668 granted May 3, 1977, to Josef Pfeifer et al. The apparatus comprises carrier means (e.g., a cylinder which is rotatable about a horizontal axis) for advancing receptor sheets along a predetermined path (preferably a cylindrical path which is defined by the periphery of the aforementioned cylinder), a vessel or an analogous source of liquid developer, a developing electrode adjacent to a portion of the path (preferably to and at a level below the six-o'clock position of the aforementioned cylindrical path) and having a plurality of channels, a pump or other suitable means for conveying liquid developer from the source and through the channels of the electrode toward the aforementioned portion of the path so that the liquid developer contacts the latent images of receptor sheets advancing along the path, and means for moving the electrode in directions toward and away from the aforementioned portion of the path. The electrode preferably includes a surface which may be composed of several spaced-apart parallel strip-shaped surfaces and is substantially parallel to the aforementioned portion of the path for receptor sheets. The means for moving the electrode is preferably constructed and assembled to move the electrode substantially at right angles to the surface of the electrode.

The apparatus preferably further comprises a tank which is open at the top and is disposed below the aforementioned portion of the path for receptor sheets. The electrode is installed in the tank, and the pump preferably delivers liquid developer into the bottom zone of the tank wherein the developer rises to the level of, in and above the channels of the electrode to form a standing wave which contacts the latent image at the outer side of the receptor sheet which is advanced past the tank. The liquid developer is furnished to the tank at a rate which is sufficient to maintain the aforementioned standing wave. The developer overflows the open top of the tank and descends into the source to be withdrawn by the pump and returned into the tank.

The moving means preferably comprises means for moving the electrode up and down in the interior of the tank. Such moving means may include one or more supports in the form of vertical columns whose upper ends carry the electrode and whose lower end portions rest on disk-shaped eccentrics which are rotatable to thereby change the level of the electrode.

The novel features which are considered as characteristic of the invention are set forth in particular in the appended claims. The improved developing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a diagram wherein two curves represent the development of latent images in heretofore known apparatus and a third curve denotes one mode of developing latent images in the apparatus of the present invention;

FIG. 2 is a transverse vertical sectional view of a developing apparatus which embodies one form of the invention;

DESCRIPTION OF THE PREFERRED EMBODIMENTS

Figure 3:
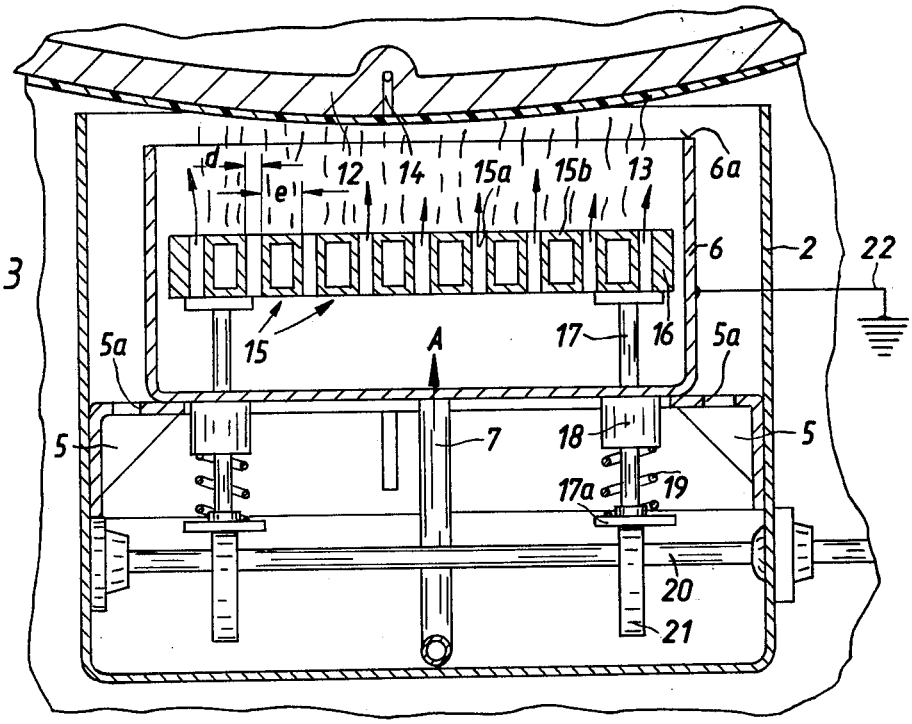
FIG. 3 is a vertical sectional view as seen in the direction of arrows from the line III—III of FIG. 2.

In the diagram of FIG. 1, the darkness D of developed image on a dielectric receptor sheet is measured along the ordinate, and the sheet portion S whose darkness or density is measured extends along the abscissa. The curve a denotes the distribution of density when the developing apparatus operates practically without any edge effect. It is assumed that the monitored portion or strip of the sheet is practically black at the left-hand side of the ordinate and is practically white at the right-hand side of the ordinate, i.e., that the transition from the dark zone to the white zone is abrupt. Owing to a number of unavoidable factors, especially deviations from optimum exposure and optimum development, those portions of the curve a which are adjacent to the ordinate do not coincide with the ordinate but slope downwardly toward the abscissa at an angle other than 90 degrees. Therefore, the curve a does not represent the optimum development curve without any edge effect but rather that curve which represents the optimum development of latent images in accordance with heretofore known procedures.

The curve b denotes that distribution of darkness or density which can be achieved in a developing apparatus without a developing electrode (all other factors being assumed to be identical with those which led to the development of a latent image in a manner as indicated by the curve a). The electrostatic fields are distorted as a result of close proximity of darker portions to lighter portions of the image; therefore, toner is drawn from the region of the darker image portion and accumulates at the outline of the darker image portion so that such outline exhibits a contrast which is much more pronounced than the contrast of the major part of the darker portion. At the same time, the regions which are adjacent to such pronounced outline appear to be pale, i.e., light grey or white. The center of the uniformly dark part of the image does not exhibit any (or exhibits a negligible) charge gradient; therefore, such center does not attract any toner and it is as pale as the image portions at both sides of the outline of the dark part, i.e., the center is light grey or white. Distortion of the latent electrostatic image can be avoided, by using a developing electrode, in that the field lines of discrete portions of the image interact more with the field of the developing electrode than with each other.

The curve c denotes the density or darkness which can be achieved by resorting to a developing apparatus which embodies the present invention. In addition, the improved apparatus renders it possible to develop in a manner which deviates from development indicated by the curve c, i.e., to move closer to the curve a or b. As a rule, some edge effect will be of advantage in order to enhance the contrast between darker and brighter portions of the image as well as to facilitate the recognition of details. However, and as shown by that portion of the curve c which intersects the ordinate, the edge effect serves primarily to bring the development closer to that which is represented by the curve b, i.e., that portion of the curve c which intersects the ordinate makes a relatively small acute angle with the ordinate and a much larger acute angle with the abscissa. The extent to which the major part of a relatively large dark portion of the image is developed is similar to that which is denoted by the curve a at the left-hand side of the ordinate D. On the other hand, the improved apparatus can eliminate errors of development at the outline of a dark area and can compensate for the aforementioned inherent errors; in fact, the apparatus can overcompensate for such errors. In each instance, one can regulate the intensity of development of the outlines of dark areas, i.e., the attendant can alter the impression which is created by the developed image so that it is more suitable for examination by a physician, nurse or another person in charge of evaluating X-ray images of certain objects, e.g., female breasts.

FIG. 2 shows a portion of the improved developing apparatus. The apparatus comprises a frame 1 which supports an outer vessel or source 2 serving for interception and storage of liquid developer which overflows the upper edge 6*a* of an inner vessel or tank 6. The outer vessel 2 contains a supply 4 of liquid electrophotographic developer which at most extends to the level indicated by arrow 3. The tank 6 is secured to brackets 5 which are installed in the vessel 2 and have openings 5*a* to enhance the flow of liquid developer back into the vessel 2, and the bottom portion of the tank 6 communicates with the discharge end of a pipe 17 which is connected to the outlet of a liquid conveying pump 8. The latter is submerged in the supply 4 of liquid developer in the vessel or source 2, and its shaft 9 extends vertically upwardly to receive torque from a motor 10 which is mounted in the frame 1 at a level above the vessel 2 and adjacent to the lowermost portion of the path of movement of dielectric receptor sheets 13. The reference character 11 denotes a pipe which is connected to the intake of the pump 8 and draws liquid developer from the bottom zone of the vessel 2 when the motor 10 is in operation. The direction in which the developer enters the tank 6 via pipe 7 is indicated by the arrow A. The liquid developer overflows the upper edge 6*a* of the tank 6 and descends into the vessel 2. When the rate of circulation of liquid by the pump 8 is sufficiently high, the liquid developer forms a surge or standing wave which extends above the level of the upper edge 6*a* of the tank 6. The arrangement is such that the latent image on the exposed (outer) surface of the dielectric receptor sheet 13 is contacted by the standing wave at a level above the edge 6*a*.

The sheet 13 is mounted at the periphery of a carrier 12 here shown as a one-piece or composite cylinder which is rotatable about a horizontal axis. A one-piece cylindrical carrier is disclosed in the commonly owned copending application Ser. No. 863,868 filed Dec. 23, 1977, now U.S. Pat. No. 4,147,128, by Jürgen Müller. A composite cylinder with segments which are movable with as well as relative to each other is disclosed in the commonly owned copending application Ser. No. 919,908 filed June 28, 1978 by Jürgen Müller. Irrespective of the construction of the carrier 12, the tank 6 is located below the six o'clock position of the cylindrical path which is defined by the periphery of the carrier 12 so that the liquid developer contacts successive increments of the exposed (image-bearing) side of the sheet 13 when such increments reach the lowermost portion of their path of advancement about the horizontal axis of the carrier 12. The manner in which the sheet 13 is separably secured to the carrier 12 is disclosed in the aforementioned commonly owned copending applications of Müller. As a rule, the carrier is formed with suction ports 14 which attract the sheet 13 to the peripheral surface of the carrier during travel from a sheet-admitting station, past the tank 6, and on toward a sheet evacuating station. The tank 6 can be followed by a fixing unit which stabilizes the developed image by the application of heat.

When the motor 10 for the pump 8 is arrested, the aforementioned standing wave or surge disappears and the exposed side of the sheet 13 on the carrier 12 does not contact the liquid developer. This renders it possible to utilize the apparatus for development of dielectric receptor sheets as well as for other types of treatment, e.g., in a manner as disclosed in the aforementioned copending applications of Müller. Müller discloses several corona discharge devices one of which serves to neutralize the charge of a dielectric receptor sheet and another of which serves to remove particles of dust or other foreign matter from successive increments of a sheet which is advanced therealong while the pump 8 is idle. In the first-filed application of Müller, the carrier must be configurated in a special way (it includes portions having larger and smaller radii) in order to avoid contact between the liquid developer and the sheets when the sheets are to be treated during travel past one or more corona discharge devices, i.e., when the apparatus is not used for development of latent images.

In order to reduce the turbulence of liquid developer which enters the tank 6 via pipe 7 and overflows at the upper edge 6*a*, the tank 6 contains a specially designed electrode consisting of elongated parallel metallic elements 15 confined in a rectangular or square frame 16 which is also located in the tank 6. The electrode is mounted on upright supports 17 in the form of columns whose intermediate portions are axially movably received in guide sleeves 18 secured to the bottom wall 6*a* of the tank 6. The clearances between the internal surfaces of the guide sleeves 18 and the peripheral surfaces of the respective columns or supports 17 are small, negligible or zero. In other words, the rate at which liquid developer can leak from the tank 6 into the vessel 2 via sleeves 18 should not reach a value at which the liquid developer would be incapable of forming a sheet-contacting standing wave.

Figure 4:
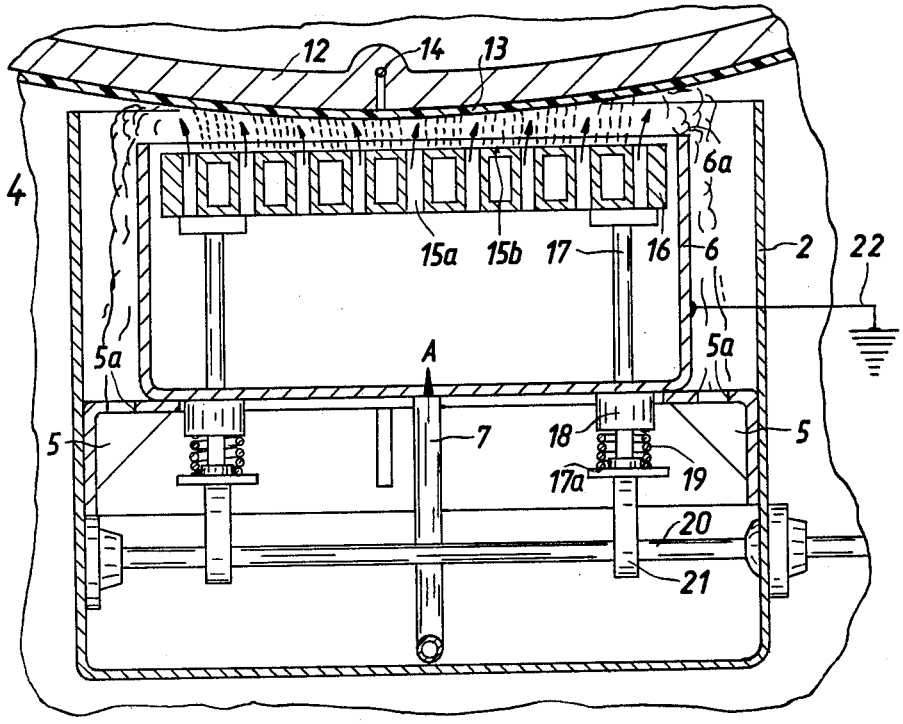
FIG. 4 illustrates the structure of FIG. 3 but with the developing electrode located nearer to the path for dielectric receptor sheets.

The flange-like lower end portions 17*a* of the columns 17 rest on the peripheral surfaces of eccentrically mounted disk-shaped moving members or eccentrics 21 which are rigid with horizontal shafts 20 journalled in the vessel 2 and frame 1. The exposed end portions of the shafts 20 can be rotated by knobs, wheels, crank handles or other suitable actuating means (not shown) to thereby move the elements 15 of the electrode nearer to or further away from the lowermost portion of the path of movement of a sheet 13 at the periphery of the carrier 12. The end portions 17*a* are biased against the respective eccentrics 21 by the weight of the developing electrode. In addition, the apparatus can be provided with auxiliary biasing means to urge the end portions 17*a* against the eccentrics 21. FIGS. 2, 3 and 4 show helical springs 19 which react against the sleeves 18 and bear against the lower end portions 17*a* to yieldably urge the columns 17 against the respective eccentrics 21. The directions in which the shafts 20 are rotatable to move the electrode to any one of a practically infinite number of different positions (in each of which the electrode is located at a different distance from the path for the sheets 13) are indicated by arrows B and C.

Each electrode element 15 may constitute a solid metallic bar or slab. Alternatively, and as shown in FIGS. 3 and 4, each element 15 may constitute a hollow tubular body with a rectangular or square cross-sectional outline. In each instance, the width d of the elongated passages or channels 15*a* between neighboring elements 15 is less than (and preferably a small fraction of) the width e of an element 15. The elements 15 extend transversely of the direction of movement of a sheet 13 past the developing station above the tank 6, i.e., they are parallel to the axis about which the carrier 12 rotates. The coplanar upper sides or surfaces of the elements 15 are shown at 15*b*. These surfaces 15*b* form a composite horizontal surface which is substantially parallel to the adjacent portion of the path for the sheets 13. All elements 15 of the developing electrode are connected with one pole of a source of electrical energy by conductor means 22. In the embodiment of FIGS. 2–4, the developing electrode is connected to the ground. Actually, the electrode elements 15 are connected to the metallic tank 6 which is connected to the ground by the conductor means 22. It is clear that a different potential can be applied to the electrode elements 15 if such different potential promotes or otherwise enhances the developing process.

The electrode elements 15 divide the rising body of liquid developer in the tank 6 into a plurality of narrow streams which flow through the channels 15*a* between the elements 15 and form a substantially laminar flow. The level of such flow rises above the level of the upper edge 6*a* and the turbulence of such flow is either negligible or zero so that the liquid developer promotes but cannot adversely influence the developing process. By properly selecting the output of the pump 8, the laminar flow has a relatively small velocity component from the central region of each channel 15*a* toward the ends of such channel and the adjacent portion of the upper edge 6*a*. Such velocity component is desirable because it insures that each and every increment of the outer side of the moving sheet 13 is contacted by fresh liquid developer. However, the velocity of liquid developer in the channels 15*a* between the elements 15 of the developing electrode does not suffice to wash away any toner which has already deposited on the latent image of an X-rayed object. As mentioned above, the danger of removing toner from a latent image which is obtained by an electroradiographic method is much more pronounced than when the latent images are obtained by resorting to electrophotographic techniques. As a rule, the charge of a latent image which is obtained in an ionography imaging chamber is approximately 50 volts; on the other hand, the charge of an electrophotographically obtained latent image is normally between 500 and 1,000 volts.

The operator will move the upper surfaces 15*b* of the elements 15 closer to or away from the path for the sheet 13 on the carrier 12 in order to change the influence of the electrode upon the development of latent images. Thus, when the electrode is moved away from the carrier 12 (see FIG. 3), the development of latent images more closely resembles that which is represented by the curve a of FIG. 1. On the other hand, the development of latent images will more closely resemble that which is denoted by the curve b of FIG. 1 if the electrode is moved nearer to the carrier 12 (see FIG. 4).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In an apparatus for treating latent images on receptor sheets with a liquid developer, particularly for developing latent images on dielectric receptor sheets which were exposed to object-modulated X-rays in an ionography imaging chamber, the combination of carrier means for advancing receptor sheets along a predetermined path; a source of liquid developer; a developing electrode adjacent to a portion of said path and having a plurality of channels; means for conveying liquid developer from said source and through said channels toward said portion of said path so that the liquid developer contacts and treats the latent images on receptor sheets advancing along said path to transform the same into developed images; and means for selectively varying the contrast and edge effect of the developed images, including means for moving said electrode in directions toward and away from said portion of said path.

2. The combination of claim 1, wherein said electrode has a surface which is substantially parallel to said portion of said path and said directions are substantially normal to said surface.

3. The combination of claim 1, wherein said electrode is disposed below said portion of said path and further comprising a tank having an open top, said electrode being located in said tank and said conveying means including means for supplying liquid developer from said source into said tank at a rate sufficient to cause the liquid developer to rise into and above said channels and to thereby contact a receptor sheet in said portion of said path.

4. The combination of claim 3, wherein said electrode consists of metal.

5. The combination of claim 4, further comprising means for connecting said electrode to one pole of a source of electrical energy.

6. The combination of claim 3, wherein said moving means includes means for moving said electrode up and down in said tank.

7. The combination of claim 1, wherein said electrode comprises a plurality of substantially parallel elongated elements and said channels are disposed between the neighboring elements of said electrode.

8. The combination of claim 7, wherein the width of said elements, as considered at right angles to the longitudinal directions thereof, exceeds the width of said channels.

9. The combination of claim 7, wherein said elements extend substantially transversely of the direction of advancement of receptor sheets along said portion of said path.

10. The combination of claim 1, wherein said moving means comprises at least one elongated support for said electrode, said support extending substantially at right angles to the plane of a sheet in said portion of said path and said moving means further comprising means for moving said support lengthwise.

11. The combination of claim 10, wherein said means for moving said support lengthwise comprises a rotary eccentric.

12. The combination of claim 11, further comprising means for biasing said support against said eccentric.

13. The combination of claim 11, wherein said support is substantially vertical and includes a lower end portion abutting against said eccentric, said electrode being mounted on top of said support so that the weight of said electrode urges the lower end portion of said support against said eccentric.

14. The combination of claim 1, wherein said source includes a first vessel and further comprising a second vessel disposed within the confines of said first vessel and having an open top, said electrode being located in said second vessel at a level below said portion of said path and said conveying means including means for pumping liquid developer from said first vessel into said second vessel wherein the developer rises in said channels to contact the latent image of a sheet in said portion of said path and the developer continuously overflows the open top of said second vessel to descend into said first vessel.

15. The combination of claim 14, wherein said moving means includes means for moving said electrode up and down in the interior of said second vessel.

* * * * *